US008437490B2

(12) United States Patent
Marton

(10) Patent No.: US 8,437,490 B2
(45) Date of Patent: May 7, 2013

(54) CEILING MICROPHONE ASSEMBLY

(75) Inventor: Trygve Frederik Marton, Oslo (NO)

(73) Assignee: Cisco Technology, Inc., San Jose, CA (US)

( * ) Notice: Subject to any disclaimer, the term of this patent is extended or adjusted under 35 U.S.C. 154(b) by 775 days.

(21) Appl. No.: 12/691,509

(22) Filed: Jan. 21, 2010

(65) Prior Publication Data

US 2010/0215189 A1 Aug. 26, 2010

(30) Foreign Application Priority Data

Jan. 21, 2009 (NO) ..... 20090325

(51) Int. Cl.
*H04R 9/08* (2006.01)
*H04R 11/04* (2006.01)

(52) U.S. Cl.
USPC ..... 381/356; 381/357; 381/361; 381/91; 381/122

(58) Field of Classification Search ..... 381/26, 381/91, 92, 122, 356, 357, 358, 360, 361, 381/365, 366, 111, 113
See application file for complete search history.

(56) References Cited

U.S. PATENT DOCUMENTS

| | | | | |
|---|---|---|---|---|
| 3,243,768 | A | 3/1966 | Roshon, Jr. et al. | |
| 3,992,586 | A * | 11/1976 | Jaffe | 381/83 |
| 4,314,098 | A | 2/1982 | Maerfeld | |
| 4,675,906 | A * | 6/1987 | Sessler et al. | 381/92 |
| 5,103,927 | A | 4/1992 | Heavener | |
| 5,524,056 | A * | 6/1996 | Killion et al. | 381/314 |
| 5,574,793 | A * | 11/1996 | Hirschhorn | 381/361 |
| 5,742,693 | A | 4/1998 | Elko | |
| 7,146,013 | B1 * | 12/2006 | Saito et al. | 381/92 |
| 7,409,068 | B2 * | 8/2008 | Ryan et al. | 381/313 |
| 7,660,428 | B2 * | 2/2010 | Rodman et al. | 381/355 |
| 7,995,731 | B2 * | 8/2011 | Vernick | 379/202.01 |
| 8,259,959 | B2 * | 9/2012 | Marton et al. | 381/92 |
| 2003/0163326 | A1 | 8/2003 | Maase | |
| 2003/0169891 | A1 | 9/2003 | Ryan et al. | |

FOREIGN PATENT DOCUMENTS

| | | | |
|---|---|---|---|
| DE | 196 26 933 | A1 | 1/1998 |
| JP | 2002-135879 | A | 5/2002 |
| WO | WO 2004/016041 | A1 | 2/2004 |

OTHER PUBLICATIONS

U.S. Appl. No. 12/645,701, filed Dec. 23, 2009, Marton.
U.S. Appl. No. 12/637,444, filed Dec. 14, 2009, Marton et al.
Anonymous: "Peripheral Equipment", Tandberg Product Specifications, [Online] 2002, XP002528844 Retrieved from the Internet: URL:http://omnipresence.com/PDFs/Tandberg_Ceiling_Mounted_Microphone.pdf> pp. 1-2.

* cited by examiner

*Primary Examiner* — Xu Mei
(74) *Attorney, Agent, or Firm* — Oblon, Spivak, McClelland, Maier & Neustadt, L.L.P.

(57) ABSTRACT

A video teleconferencing directional microphone has two surfaces joined with an angle of 90° relative to each other, a first omni directional microphone element arranged adjacent to the intersection between the two surfaces. The ceiling microphone assembly also includes a second omni directional microphone element arranged at a predetermined distance (d) from both surfaces. A subtractor subtracts the output of the first microphone element from the output of the second microphone element, and the output of the subtractor is equalized by an equalizer ($H_{eq}$) to generate an equalized output. The surfaces and subtractor generates a quarter toroid directivity pattern for the ceiling microphone assembly. The quarter toroid sensitivity pattern increases sensitivity in the direction of a sound source of interest, but reduces sensitivity to any sound waves generated by noise sources at other locations or reverberations.

21 Claims, 6 Drawing Sheets

CEILING MICROPHONE ASSEMBLY

CROSS-REFERENCE TO RELATED APPLICATIONS

This application is based on and claims priority to Norwegian Application No. NO20090325, filed Jan. 21, 2009, the entire contents of which are incorporated herein by reference. This application is also related to copending U.S. application Ser. No. 12/637,444, entitled "Toroid Microphone Apparatus" and filed Dec. 14, 2009, U.S. application Ser. No. 12/645,701, entitled "Elevated Toroid Microphone Apparatus" and filed on Dec. 23, 2009, and U.S. Provisional Application No. 61/140,307 entitled "Elevated Toroid Microphone Apparatus" and filed Dec. 23, 2008. The entire contents of these U.S. applications are incorporated herein by reference.

BACKGROUND

A microphone assembly is provided. More specifically, a ceiling mounted microphone assembly having a sensitivity pattern that is independent of the microphone's elevation angle. The microphone maximizes sensitivity in the direction of a sound source of interest, but minimizes sensitivity to sound from other directions.

Teleconferencing systems, which can implement audio-only teleconferences or video and audio teleconferences, create meetings between two or more parties that are separately located, such as in separate rooms. The rooms may be within a same building or in different buildings, and the difference building can be located in different cities, countries, continents, etc. Thus, teleconferencing systems create meetings that would otherwise require travel of potentially large distances.

Video teleconferencing systems create virtual meetings by transmitting both video and audio data, and thus include one or more microphones to capture sound waves. The microphones convert sound waves generated in one video teleconferencing room into electrical impulses for transmission to another video teleconferencing room. Audio quality is therefore directly dependent on the positioning of the microphone within the room, the acoustics of the room, and to the characteristics of the microphone itself.

For example, a conventional microphone used to capture sound from a sound source of interest, such as a person speaking, will receive direct sound waves, reflected sound waves and reverberant sound waves from the source. Direct sound waves travel directly to the microphone without reflection, and are the sound waves intended to be captured by microphones. The level of direct sound waves is inversely proportional to the distance between the sound source of interest and the microphone receiving the sound.

Reflected sound waves do not travel directly to the microphone. Instead, they are reflected multiple times by objects in the room, or the room itself, before reaching the microphone. For example, sound waves from a sound source of interest may be reflected by walls, floors, ceilings, chairs, etc. Reflected sounds waves that propagate less than 50-80 ms (corresponding to a propagation distance of 17 to 27 meters) before reaching the microphone are known as "early reflections." Early reflections have pressure levels approximately equal to those of direct sound waves, but are delayed in time.

Early reflections from the sound source of interest may positively contribute to the audio received by the microphone. However, they may also distort the audio because the time delay causes a phase difference between the early reflections and the direct sound wave that results in cancellation of part of the frequency components of the direct sound waves. This phenomenon is known as "comb filtering", and negatively impacts quality.

Reflections that propagate for more than 50 to 80 ms (17 to 27 meters) are known as "reverberant sound". Reverberant sound arrives at the microphone from nearly every direction because these sound waves have reflected many times within the room. Also, their pressure level is largely independent of microphone-sound-source distance. Unlike early reflections, reverberant sound always contributes negatively to audio quality by creating a "distant", "hollow", and/or "muffled" characteristic.

The level of distortion cause by reverberant sound is determined by a ratio of a level of direct sound to a level of reverberant sound. For example, if the sound source of interest is very close to the microphone the ratio of direct sound to reverberant sound is large, and distortion is small. As the sound source of interest moves away from the microphone the ratio of direct sound to reverberant sound will decrease, increasing distortion.

A distance at which the level of the direct sound equals the level of the reverberant sound is known as the "room radius", which can be determined for every room. As a sound source of interest moves outside of the room radius, reverberant sound dominates and distortion increases. Conversely, as the sound source moves within the room radius the direct sound dominates, and distortion decreases. Therefore, in conventional microphone systems, the sound source of interest should remain within the room radius to avoid significant audio distortion.

Direct sound, reflected sound, and reverberant sound are not limited to the sound source of interest, and can also be present for noise sources in a video teleconferencing room. Noise sources include, for example, fan noise from ventilation systems, cooling fan noise from electronic equipment, noises from outside of the video teleconferencing room, and noises made directly on the table by people writing with pens, setting down cups, table-top computer keyboard typing, moving chairs, etc. Conventional teleconferencing system microphones receive direct, reflected and reverberant sound waves from these noise sources as well, deteriorating audio quality.

Further, each noise source has a different dominant component. For example, cooling fans installed on electrical equipment and noise originating from outside the video teleconferencing room primarily contribute noise in the form of reverberant sound waves. Noise generated directly on the table-top surface on which the microphone is placed contributes direct sound waves that travel parallel to the surface of the table. Some noise sources, such as ventilation systems, can also contribute multiple noise components, such as direct and reverberant sound waves.

Conventional microphones may also contribute noise in the form of an echo. An echo occurs when sound from a loudspeaker used to reproduce remote party audio is captured by the microphone and retransmitted to the remote party. Echoes also have direct, reflected and reverberant sound components, but dominance of one component over the others is determined by a loudspeaker-to-microphone distance, which is not always constant.

Echoes are conventionally attenuated with echo cancellers, which are adaptive filters that train to a loudspeaker-microphone channel response. However, echo cancellers cannot prevent a microphone from receiving an echo. Instead, echo cancellers merely attenuate echoes already present in an audio signal. Because of their adaptive nature, echo cancellers require time to adapt to a given response, making time-invariant loudspeaker-microphone channel responses desirable. In practice, however, microphones are often repositioned during a video teleconference in order to capture audio from several different sound sources, and time-invariant loudspeaker-to-microphone channels are difficult to achieve. Thus, a conventional video teleconferencing system's echo cancellers are typically required to adapt multiple times. Moreover, echo cancellers have difficulty attenuating reverberant sound components, resulting in increased computational complexity as the level of reverberant echoes increase.

The above problems are exacerbated when omni directional microphones are used in video teleconferencing systems. An omni directional microphone receives audio from all directions with equal sensitivity, and thus receives direct, reflected and reverberant sounds from every sound source within the room, including noise sources. In fact, only noise sources below the conference table is attenuated because the table functions as a barrier to sound pressure waves. Though omni directional microphones are capable of capturing audio from all sound sources of interest without being repositioned, the resulting audio quality is poor because of captured noise.

One way to improve the quality of audio transmitted by a video teleconferencing system is to use directional microphones. Unlike omni directional microphones, a directional microphone has higher sensitivity with respect to certain directions over others, and inherently filters sound from at least some noise sources. This improves audio quality relative to an omni directional microphone, but also requires that a directional microphone be oriented to align its direction of highest sensitivity ("main axis") toward the sound source of interest. Therefore, the directional microphone requires repositioning every time the sound source of interest changes position.

Directional microphones having a cardioid sensitivity pattern or a bidirectional sensitivity pattern are typically used in video teleconferencing. A microphone having a cardioid sensitivity has a directivity function given by: $g(\alpha)=1/2+1/2\times\cos(\alpha)$, where $\alpha$ is the azimuth angle of a main axis with respect to horizontal. A typical cardioid microphone has a maximum sensitivity at $\alpha=0°$ and a minimum sensitivity at $\alpha=180°$.

A bidirectional microphone has a directivity function given by: $g(\alpha)=\cos(\alpha)$, where $\alpha$ is also the azimuth angle of a main axis with respect to horizontal. This microphone has a maximum sensitivity for $\alpha=0°$ and $\alpha=180°$, and a minimum sensitivity when $\alpha=90°$ and $\alpha=270°$. Because both the cardioid and bidirectional sensitivity patterns depend on the azimuth angle of the microphone, sensitivity for these microphones varies horizontally and vertically.

As discussed above, either a cardioid microphone or a bidirectional microphone may be used in a video teleconferencing system to improve audio quality. Placing the cardioid or bidirectional microphone on a table also improves audio quality because the table acts as a sound barrier to sound origination below the table surface, improving the direct to reverberant audio ratio.

Microphone sensitivity may also be improved by placing the microphone directly on the table-top surface because at this level the microphone receives direct sound waves and sound waves reflected by the table (i.e. early reflections). The direct sound waves and reflected sound waves reflected by the table, however, remain in phase and combine to form a pressure wave that is double that of the direct sound wave. This effectively increases the microphone sensitivity is by six decibels, and is commonly referred to as the "boundary principle."

Directional microphones still have the drawback of requiring the sound source of interest to remain located near the main sensitivity direction of the microphone. When several people take part in the meeting, the microphone must be continually readjusted to avoid diminished audio quality. Thus, parties to the video teleconference must be aware of the sensitivity patterns of the microphone and adjust the position of the microphone accordingly. This makes directional microphones difficult to use.

One conventional method of reducing sensitivity to noise from the table and to orient all sound sources of interest to the "line of sight" (i.e. area of heightened sensitivity) of the microphone is to hang the microphone from the ceiling. Directional microphones, such as cardioid microphones, are often used in hanging microphone applications. However, the sensitivity pattern of hanging directional microphones is less focused than that of tabletop microphones because hanging microphones lack the shielding provided by a table surface. The missing table surface prevents hanging directional microphones from exploiting the boundary principle described above, and hanging directional microphones have relatively higher levels of self-noise compared to their tabletop counterparts. Conventional hanging directional microphones are also more susceptible to reverberant sound. Hence, conventional hanging directional microphones are only suitable for short-range use.

SUMMARY

A microphone assembly according to the present disclosure includes an L-shaped structure formed by a first planar surface perpendicularly attached to a second planar surface. A first microphone element is disposed at the intersection of the first and second planar surfaces, and a second microphone element disposed along a line bisecting an angle formed by the first and second planar surfaces. The second microphone element is a predetermined distance from both the first and second planar surfaces. A first subtractor is provided to subtract an output of the first microphone element from an output of the second microphone element, and a first equalizer to equalize the output of the first subtractor is also provided. The first equalizer has a frequency response of Heq. A quarter toroid sensitivity pattern for the microphone assembly is generated by acoustical interaction of the two planar surfaces with the two microphone elements and subtraction of the microphone element outputs.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings. However, the accompanying drawings and their exemplary depictions do not in any way limit the scope of the inventions embraced by this specification. The scope of the inventions embraced by the specification and drawings are defined by the words of the accompanying claims.

DETAILED DESCRIPTION

In the following, the present advancement is discussed by describing preferred embodiments with reference to the accompanying drawings. However, those skilled in the art will recognize other applications and modifications within the scope of the disclosure as defined in the enclosed claims.

Figure 1:
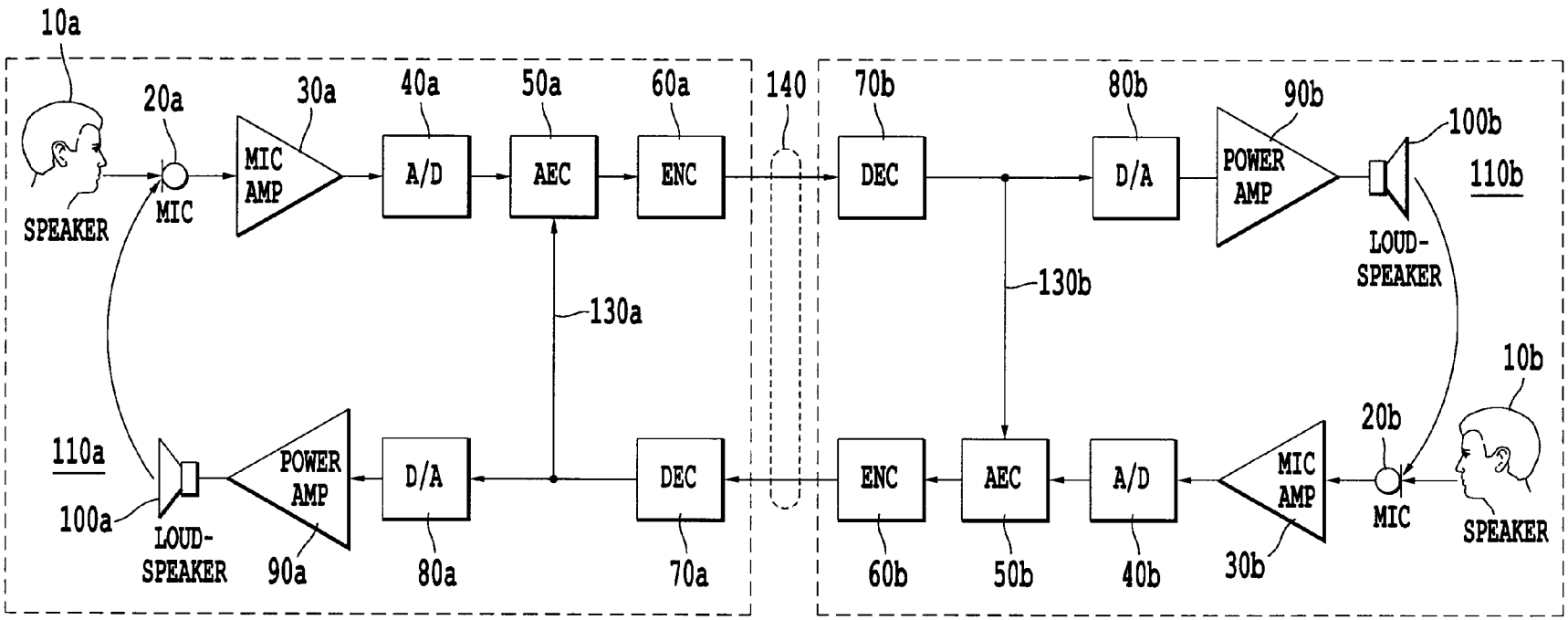
FIG. 1 is a schematic drawing of a video teleconferencing system's audio distribution section that includes microphones according to an exemplary embodiment of the present disclosure.

FIG. 1 is a schematic representation of an audio portion of a video teleconferencing system. In FIG. 1, speaker 10*a*, in room 110*a*, and speaker 10*b*, in room 110*b*, are engaged in a video teleconference. Rooms 110*a* and 110*b* may be physically adjacent to each other in the same building, or separated by many hundreds or thousands of miles, and communication link 140 is used to transfer video and audio data between rooms 110*a* and 110*b*.

The exemplary communication link 140 may be wired, such as a PSTN telephone system, Wide Area Network (WAN), Local Area Network (LAN), or Ad-hoc. The exemplary communication link 140 may also be a wireless, such as a cellular network, WiMax, Wifi, or via satellite link. Further, the communication link 140 may also be a combination of the wired and wireless networks.

Rooms 110*a* and 110*b* of FIG. 1 are mirror images of each other, and contain the same equipment. Of course, those skilled in the art will recognize that alternative configurations are embodied by the advancements described herein. Each room 110*a* and 110*b* includes a ceiling microphone assembly 20*a* or 20*b*, a microphone amplifier 30*a* or 30*b*, an A/D converter 40*a* or 40*b*, an echo canceller 50*a* or 50*b*, an encoder 60*a* or 60*b*, a decoder 70*a* or 70*b*, a D/A converter 80*a* or 80*b*, a power amplifier 90*a* or 90*b*, and a loudspeaker 100*a* or 100*b*.

When speaker 10*a* speaks, the sound waves from his or her voice travel to ceiling microphone 20*a* and are converted to electrical impulses. Microphone amplifier 30*a* amplifies these electrical impulses, and A/D converter 40*a* converts them to digital audio data. The digital audio data then travels to the echo canceller 50*a*, which taps the output of decoder 70*a* using transmission path 130*a*, to reduce any echo contained in the digital audio data. Once the echo has been reduced, the digitized audio data is transferred to the encoder 60*a*, which encodes the digitized signal according to a format of the communication link 140. The communication link 140 then carries the digitized audio data to room 110*b*.

Digital audio data received at room 110*a* is first decoded by the decoder 70*a* according to the transmission protocol of the communication link 140. This decoded digital audio data is used to reduce echo, as discussed above, and also converted into electrical impulses by the D/A converter 80*a*. The electrical impulses are amplified by the power amplifier 90*a* and converted to sound waves by the loudspeaker 100*a*.

Though the above description refers only to room 110*a*, it is equally applicable to room 110*b*. Therefore, the audio portions of the video teleconferencing systems in rooms 110*a* and 110*b* allow speakers 10*a* and 10*b* to simultaneously exchange audio data across the communication link 140.

Moreover, microphone amplifier 30*a*, A/D converter 40*a*, echo canceller 50*a*, encoder 60*a*, decoder 70*a*, D/A converter 80*a*, and power amplifier 90*a* may be implemented separately as hardware or software elements or integrated into a single device such as an ASIC "System on a Chip". Microphone amplifier 30*b*, A/D converter 40*b*, echo canceller 50*b*, encoder 60*b*, decoder 70*b*, D/A converter 80*b*, and power amplifier 90*b* may be similarly integrated, or individually implemented.

While a video teleconference is described above with respect to two speakers in two rooms, other configurations are also possible. For example, three or more rooms may by linked by communication link 140 to a common teleconference, and more than one speaker may also be present in each of the rooms. Additionally, a self-contained, table-top teleconference unit may be used to allow each speaker to join the teleconference without leaving their desk, and some speakers may also join the teleconference using audio-only communications. As those skilled in the art will recognize, numerous other video teleconferencing configurations are possible without departing from the scope of the present disclosure.

Figure 2A:
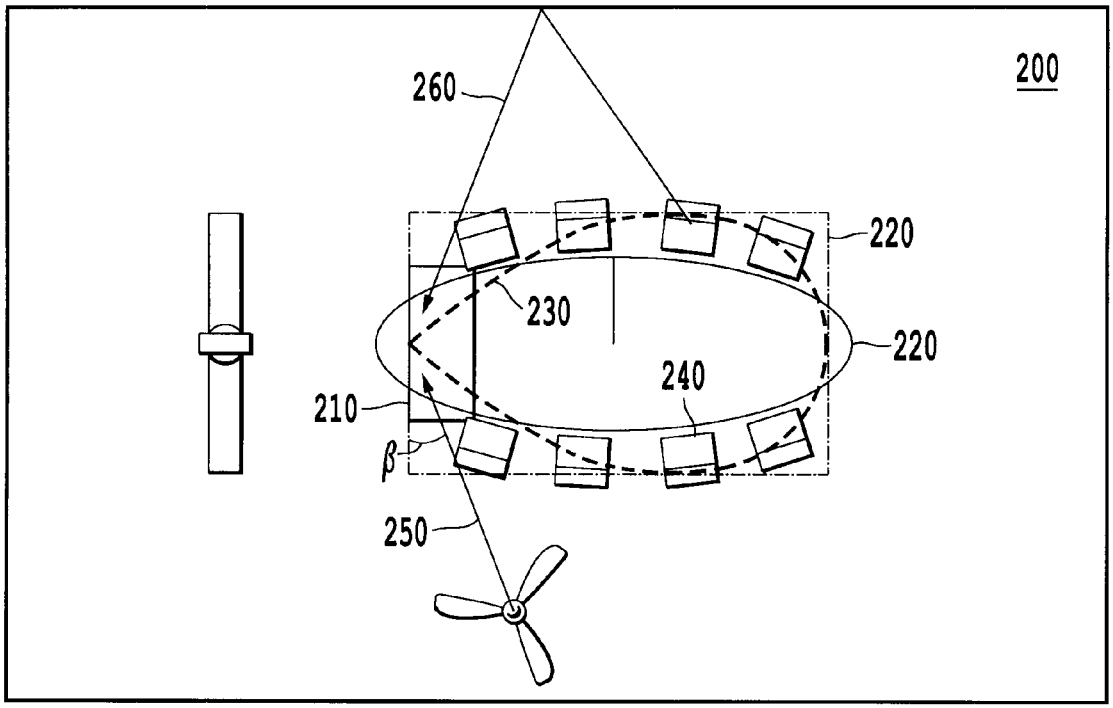
FIG. 2*a* is a schematic drawing of the sensitivity patterns of a ceiling microphone assembly arranged overhead according to an exemplary embodiment of the present disclosure.

FIG. 2*a* is an overhead view of room 200 according to an exemplary embodiment of the present disclosure. Room 200 includes an exemplary ceiling microphone assembly 210 mounted above an oval conference table 220. The sensitivity pattern for microphone assembly 210 includes sensitivity lobe 230 (dashed line), which define areas of heightened sensitivity. Sensitivity lobe 230 is aligned with the centre line of the conference table 220, and is wide enough to cover participants 240 located around the table. Thus, microphone assembly 210 is more sensitive to sound originating from participants 240 than from other sources. For example, microphone assembly 210 is relatively insensitive to sound coming from the fan 250 and/or reverberant sound 260).

Figure 2B:
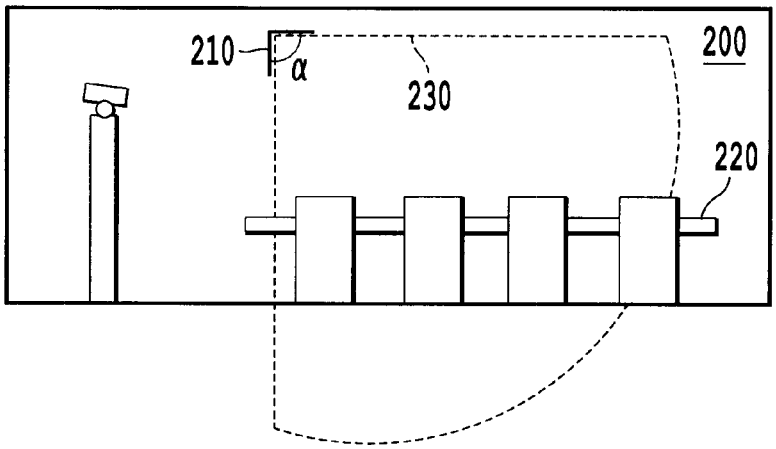
FIG. 2*b* is another schematic drawing of the sensitivity patterns of a ceiling microphone assembly arranged overhead according to an exemplary embodiment of the present disclosure.

FIG. 2*b* is a side view of room 200. As illustrated in FIG. 2*b*, the sensitivity pattern of the ceiling mounted microphone assembly 210 is independent of the elevation angle $\alpha$, and is highest in an area 270.

In FIGS. 2*a* and 2*b*, the ceiling microphone 210 and table 220 are merely exemplary, and therefore not limiting. Those of skill in the art will recognize that the microphone assembly 210 can be mounted at any height and position. The microphone assembly 210 can also be of any size, form and material that is known.

Table 220 can also be of any shape, height, and material that is known, as those of skill in the art will recognize. Further, though participants 240 are shown positioned around table 220, the participants may also be sitting scattered, i.e. like in a class room, on rows, i.e. like in a auditorium, or any other configuration. More than one ceiling microphone assembly may also be mounted in the same room to cover large areas and room. Multiple speakers may also be accommodated by microphone assembly 210 without departing from the scope of the invention.

Figure 3:
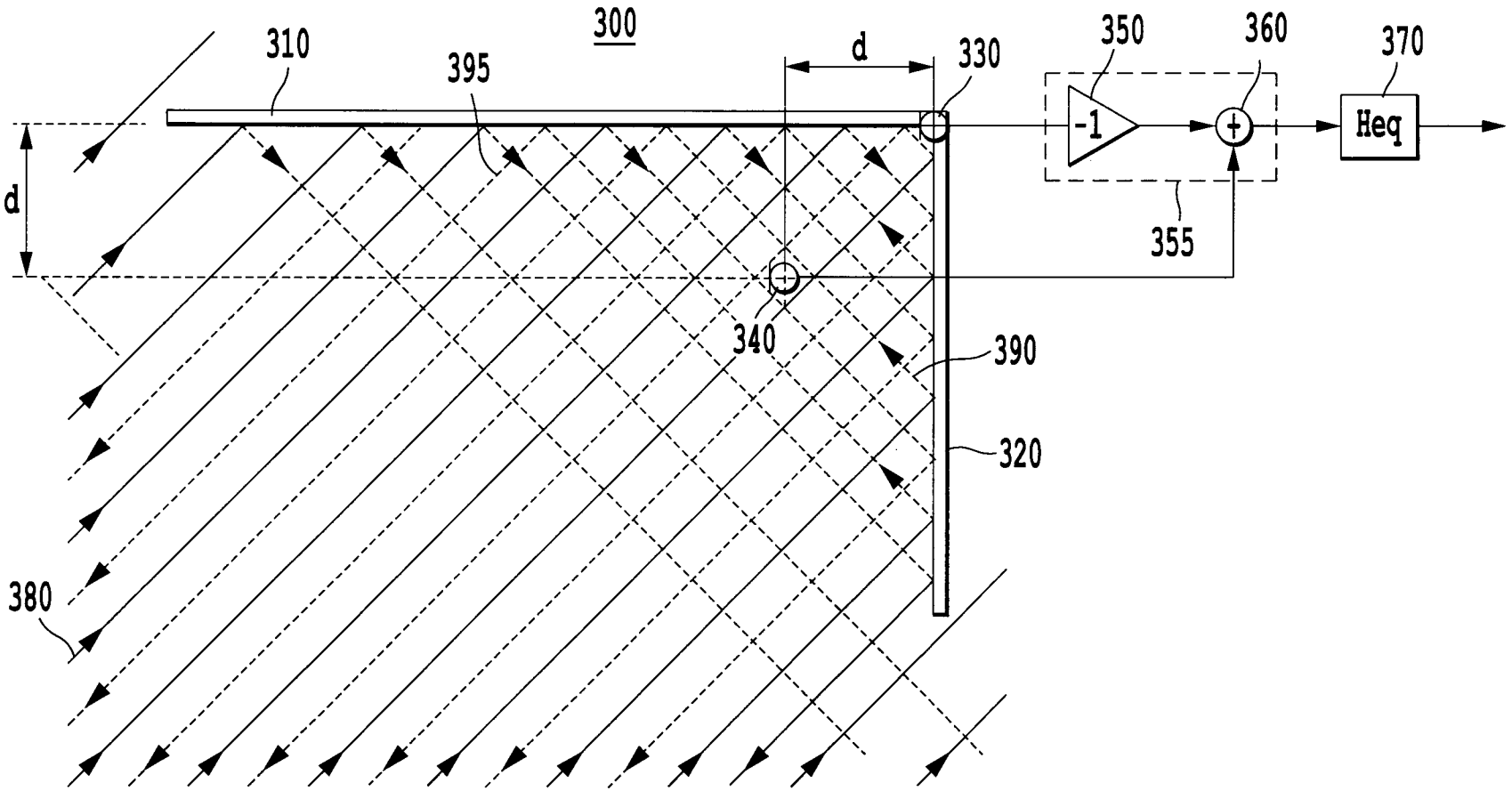
FIG. 3 is a schematic drawing of a microphone assembly according to an exemplary embodiment of the present disclosure.

FIG. 3 is a ceiling microphone assembly 300 according to an exemplary embodiment of the present invention. Ceiling microphone assembly 300 includes two plane surfaces 310 and 320 perpendicularly joined to form a structure having an L-shaped cross section. The two surfaces 310 and 320 preferably form a 90 degree angle, but other angles are possible without departing from the scope of the present disclosure. For example, two surfaces 310 and 320 can for angles in the range of 80-100 degrees as those of skill in the art will recognize. The two surfaces 310 and 320 are made of a smooth, hard and/or audio reflective surface, such as Plexiglas, glass, metal and wood.

The ceiling microphone assembly includes two microphone elements 330 and 340, such as an omni directional microphone element, and a subtractor 355. However, as those skilled in the art will recognize, other types of microphone elements, such as cardioid and bidirectional are also possible. The output of the first microphone element 330 is subtracted from the output of the second microphone element 340 in subtractor 355 and equalized in an equalizer 370, which has the frequency response of $H_{eq}$. The overall output of the ceiling microphone assembly 300 is the output of the equalizer 370.

The first microphone element 330 is arranged substantially at the intersection between the two surfaces 310 and 320 to capture both direct sound waves and early reflections from surfaces 310, 320. Preferably the first microphone is arranged in the centre of the structure formed by the two joined surfaces 310 and 320. Microphone element 330 is also arranged to exploit the boundary principle.

A second microphone element 340 is arranged at a distance (d) from microphone element 330 along a line bisecting the angle formed by the two joined surfaces 310, 320. The distance (d) is preferably chosen so that $d\sqrt{2}$ is be less than half of a wavelength of a highest-frequency component to be captured by the ceiling microphone assembly 300. However, other values for the distance (d) are possible as will be recognized by those skilled in the art In FIG. 3, direct sound waves 380 (solid lines) arrive at the surfaces 310, 320, and are reflected by one of the surfaces 310 and 320 to form reflected sound waves 390 (dashed lines.) Further reflection by other surfaces generate reflections 395 (dash-dotted line). Microphone element 330 captures both the direct sound waves 380 and reflected sound waves 390 from the two surfaces 310 and 320, making use of the boundary principle to increase sensitivity. Microphone elements 340 receive both direct sound waves 380 and reflected sound waves 390 that are delayed with respect to the direct sound waves 380. The amount of delay of the reflected sound waves 390 depends on the incoming angle (β) and the distance (d). Any sound waves originating behind and above the ceiling microphone assembly 300 are blocked by the surfaces 310, 320.

Figure 4:
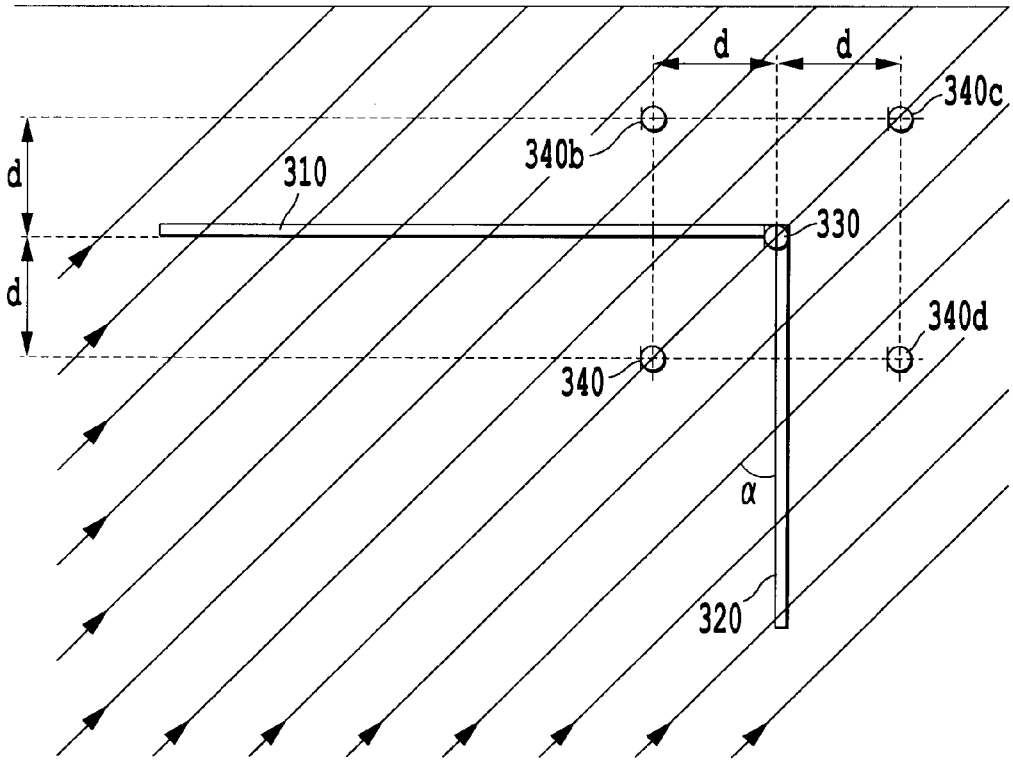
FIG. 4 is an equivalent diagram corresponding to the microphone assembly of FIG. 3.

FIG. 4 is an equivalent diagram of the exemplary ceiling microphone in FIG. 3. The equivalent diagram mirrors the microphone elements 330 and 340 about each surface 310 and 320, and the surfaces 310 and 320 are removed. In other words, the equivalent diagram of FIG. 4 includes five microphone elements implementing a ceiling microphone functionally equivalent to the ceiling microphone in FIG. 3.

More specifically, in FIG. 4 second microphone 340 is first mirrored around the first surface 310 and then the second microphone 340 and its mirrored equivalent 340*b* is mirrored around the second surface 320 to generate two additional mirrored microphone elements 340*c* and 340*d*. The total output of the second microphone element 340 equals the sum of the four equivalent microphones in FIG. 4 (340, 340*b*, 340*c* and 340*d*). The result is four versions of the same audio signal with four time delays. As those of skill in the art will recognize, the time delays corresponding to the four microphone elements 340, 340*b*, 340*c* and 340*d* may be different from one another, or two or more of the time delays may be the same.

Mirroring the first microphone element 330 around each of the two surfaces 310, 320 also results in four equivalent microphones. However, as the first microphone 330 is located at the vertex of the angle formed by surfaces 310 and 320, all of the equivalent microphones coincide to the same location as the first microphone element 330. As there is no relative delay among the four equivalent microphones corresponding to the first microphone element 330, signal level is four times that of the first microphone signal 330. This is the exact same phenomena as the pressure quadrupling caused by two surfaces.

Figure 5:
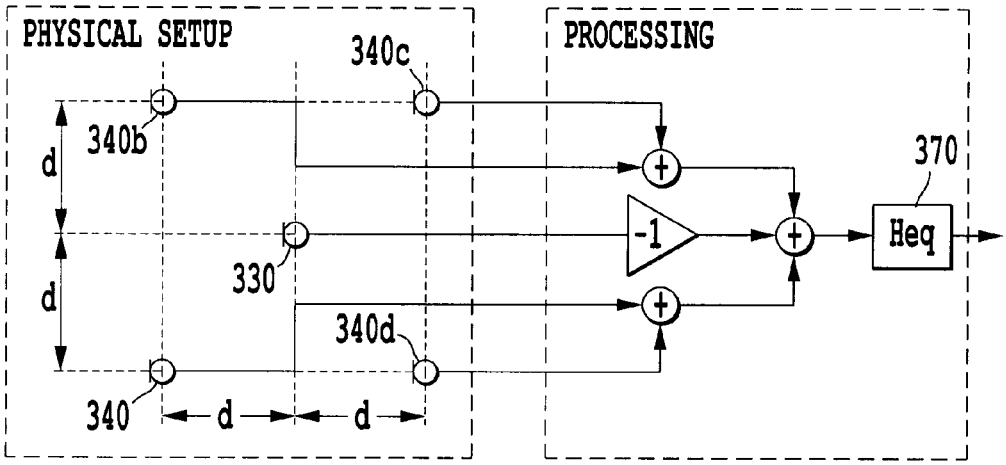
FIG. 5 is another equivalent diagram corresponding to the microphone assembly of FIG. 3.

FIG. 5 is an equivalent circuit corresponding to the equivalent diagram of FIG. 4. In FIG. 5, the first microphone element 330 outputs a first signal corresponding to the incoming sound wave acoustically amplified by a factor of four due to the two surfaces 310 and 320. The second microphone element 340 outputs a sum of four delayed versions of the same signal. The ceiling microphone of FIGS. 3, 4 and 5 therefore implements the same directive pattern for all signals impinging upon the ceiling microphone from an angle α in between the two surfaces 310 and 320.

Figure 6:
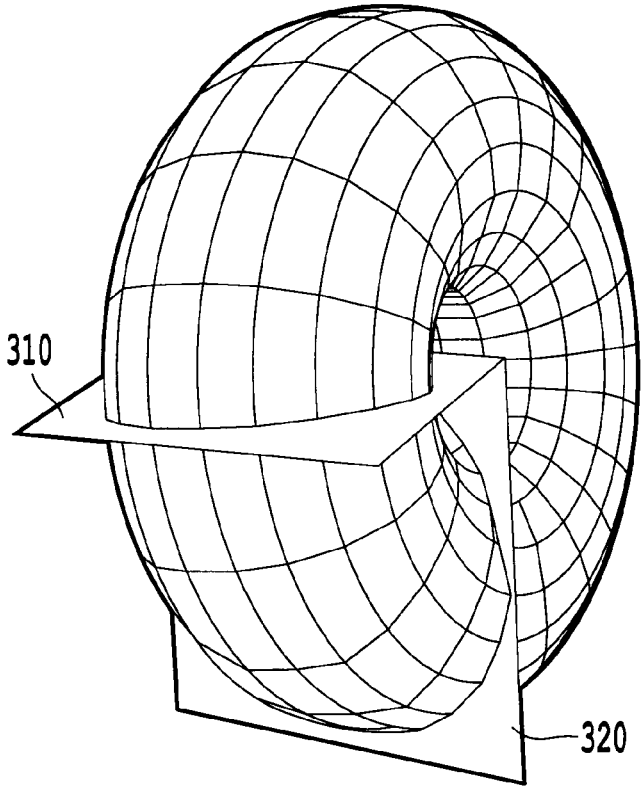
FIG. 6 is a sensitivity patterns of a ceiling microphone assembly according to an exemplary embodiment of the present disclosure.

Thus, the directivity pattern of the microphone assembly 300 is independent of the elevation angle alpha. Instead, the directivity pattern approximates $g(\beta)=\cos^2(\beta)$, where β is the angle between the incoming sound and a line defined by the intersection of the two surfaces 310, 320. The resulting directivity pattern is a quarter of a second order toroidal pattern of FIG. 6. To obtain this pattern, an equalizing filter $H_{eq}(\omega)$ must be proportional to $1/\omega^2$ for obtaining a flat frequency response.

Sound waves captured by microphone elements 330 and 340 are converted to electronic signals thereby and the signal from the first microphone element 330 is subtracted from the signal from the second microphone element 340. In FIG. 3, the signal from the first microphone element 330 is inverted with a signal inverter 350 and subsequently added to the signal from the second microphone element 340 in an adder 360. Such a configuration can, for example, be implemented as a purely analogue system. Alternatively, subtractor 355 can be only of an adder (not shown).

In a digital system, an adder circuit may also be used as subtractor 355. For example, subtractor 355 can be any unit able to subtract two signals, such as those from the first and second microphone elements 330, 340. The output of subtractor 355 is then equalized by equalizer 370, which has a frequency response ($H_{eq}$) of:

$$H_{eq}(\omega) = \frac{1}{\omega^2},$$

where w is the frequency in radians per second.

The gain of inverter 350, equalizer 370 and adding node 360 may be implemented as digital structures, in which case A/D converters (not shown) convert the analog electrical impulses from microphone elements 330, 340 into digital audio data. Equalizer 370 can be implemented as infinite impulse response (IIR) filters or finite impulse response (FIR) filters.

Subtractor 355, inverter 350 and equalizer 370 may also be implemented separately or integrated in a single device. For example, the Subtractor 355 and equalizer 370 may be implemented on a PC computer 400, such as the one in FIG. 10. The computer 400 includes a processor 405 for performing computations, a read-only memory (ROM) 430 for storing programming instructions, and a main memory 425 that may include RAM memory, FLASH memory, EEPROM memory or any other known rewritable memory. The main memory 425 stores temporary data, instructions, etc. The computer 400 also includes a display controller 420 for controlling a display device 460, a disk controller 435 for controlling a hard disk 445 and/or a CD-ROM drive 440, and an I/O interface 410 for controlling a pointing device 450 and a keyboard 455. A bus 415 interconnects all of the above-described components.

Hard disk drive 445 and CD-ROM drive 440 may be integrated into the computer 400, or may be removable. Likewise, at least a portion of the main memory 425 may also be removable. Though not shown in FIG. 10, the I/O interface 410 may also interface to a network, phone system, WiFi network, cellular network, WAN, LAN, etc.

Subtractor 355, equalizer 370 and inverter 350 may also be implemented on computer 400 as a utility application, background demon, or component of an operating system, or any combination thereof executing in conjunction with the processor 405 and an operating system, such as Microsoft VISTA, UNIX, SOLARIS, LINUX, Apple MAC-OS and other systems known to those skilled in the art.

Subtractor 355, inverter 350 and equalizer 370 may be implemented in hardware, together or separately, on devices such as FPGA's, ASIC's, microcontrollers, PLD's, or other computer readable media such as an optical disc.

In addition, microphone noise from microphone elements 330, 340 may be mitigated using bandpass filters to filter the signals from each of the microphone elements 330, 340. For example, such band pass filters can have a high-pass roll off frequency of 80 hertz since attenuation of frequencies below 80 hertz minimally impacts sound quality, but reduces noise levels attributable to the microphones 330 and 340, A/D converter, quantization and/or numerical rounding.

Alternatively, the band pass filters may have different high-pass roll-offs. For example, the second band pass filter may have a higher high-pass roll off frequency than the first band pass filter so that the signals generated by adding node 360 (or subtractor node) include only signals from the first microphone 330 element for low frequencies. This degrades the directivity pattern at low frequencies, but also reduces system noise.

A degradation of the directivity pattern at high frequencies is also acceptable in order to reduce system noise. Increasing the distance d between the second microphone element 340 and the surfaces 310, 320 causes the microphone assembly 300 to have higher sensitivity to low frequencies. This may cause some spatial aliasing at high frequencies, but also reduces system noise.

Alternatively, the system may only use the first microphone 330 for higher frequencies (as described for low frequencies in the previous paragraph), resulting in an omni directional response at high frequencies. As air dissipation dampens high-frequency reverberations, omni directional high frequency responses still yield acceptable overall sound quality.

Figure 7:
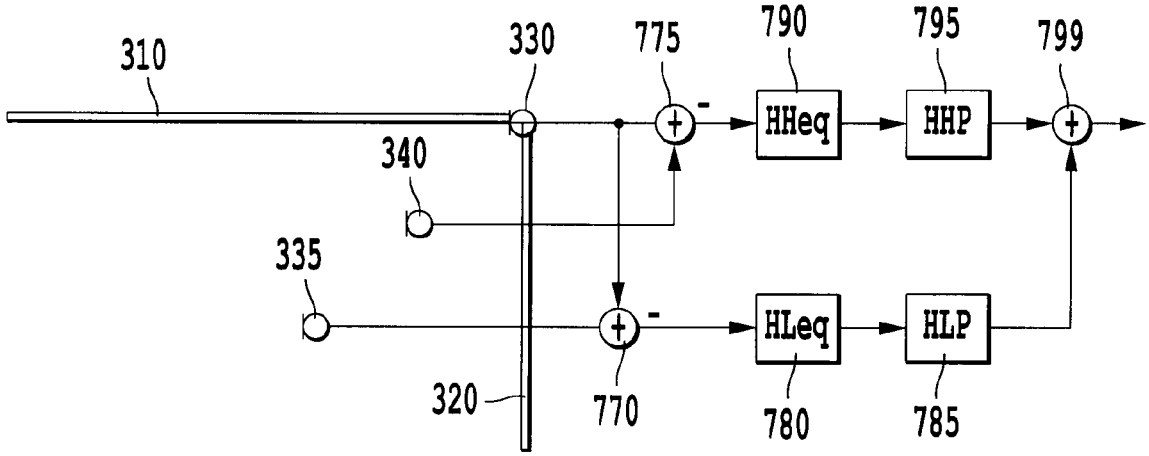
FIG. 7 is a schematic diagram of a ceiling microphone assembly according to another exemplary embodiment of the present disclosure.

FIG. 7 is another exemplary embodiment of the ceiling microphone assembly according to the present disclosure. In FIG. 7 three omni directional microphone elements 330, 340 and 335 are used to reduce the impact of system noise. Microphone element 330 is placed substantially at the intersection between the two surfaces, and microphone element 340 and 335 are aligned to microphone 330 with respect to a line bisecting the angle formed by the two joined surfaces 310, 320 to capture both direct sound waves and sound waves reflected by the surfaces 310, 320. Preferably, the first microphone 330 is arranged in the centre of the structure formed by the two joined surfaces 310, 320. Microphone 340 is a distance (d) from both surfaces 310 and 320, and microphone 335 is twice the distance (d) from both surfaces 310 and 320. In the above description, the distance (d) is preferably chosen such that $d\sqrt{2}$ is less than half of a wavelength of a highest-frequency component to be captured by the ceiling microphone assembly 300. However, as those of skill in the art will recognize other values of (d) may be used without departing from the scope of the present invention.

The sound waves captured by microphone elements 330, 340 and 335 are converted into electronic signals thereby and combined in low and high frequency subtractors 770 and 775. Specifically, the signal from the first microphone element 330 is subtracted from the signal of the third microphone element 350 in low frequency subtractor 770. The output of the low frequency subtractor 770 is then equalized by low frequency equalizer 780 and filtered by low pass filter 785.

For high frequencies, the signal from the first microphone element 330 is subtracted from the signal of the second microphone element 340 in the high frequency subtractor 775. The output of the high frequency subtractor 775 is then equalized by high frequency equalizer 790 and high pass-filtered by high pass filter 795.

The outputs of low pass filter 785 and high pass filter 795 are summed at the summing node 799 to obtain the output of the ceiling microphone assembly.

As discussed above, the subtractors 770 and 775 can be implemented with a signal inverter and adder, only with an adder (as shown), or any other unit able to subtract signals that is known. Further, subtractors 770 and 775 may be implemented as analog or digital circuits. Also in FIG. 7 $HH_{eg}=HL_{eg}=H_{eq}$.

The high pass filter 795 removes any low frequency components remaining in the output of equalizer 790, and low pass filter 785 removes any remaining high frequency components before being summed at summing node 799 to generate the overall ceiling microphone output. Thus, the ceiling microphone assembly of FIG. 7 uses microphones 330 and 340, which are closely spaced together, to capture high-frequency sound waves, and microphones 340 and 335, which are spaced further apart, to capture low-frequency sound waves. This two-way system implements a high frequency quarter toroid sensitivity pattern and a low frequency quarter toroid sensitivity pattern to remove system noise without distorting microphone sensitivity. As those skilled in the art will recognize, the two-way system of FIG. 7 may be extended to a three-way system, four-way system, or even an n-way system, where n is any positive integer. Further, any of the above-described system noise reduction techniques may be combined to further optimize performance of the ceiling microphone assembly.

Figure 8:
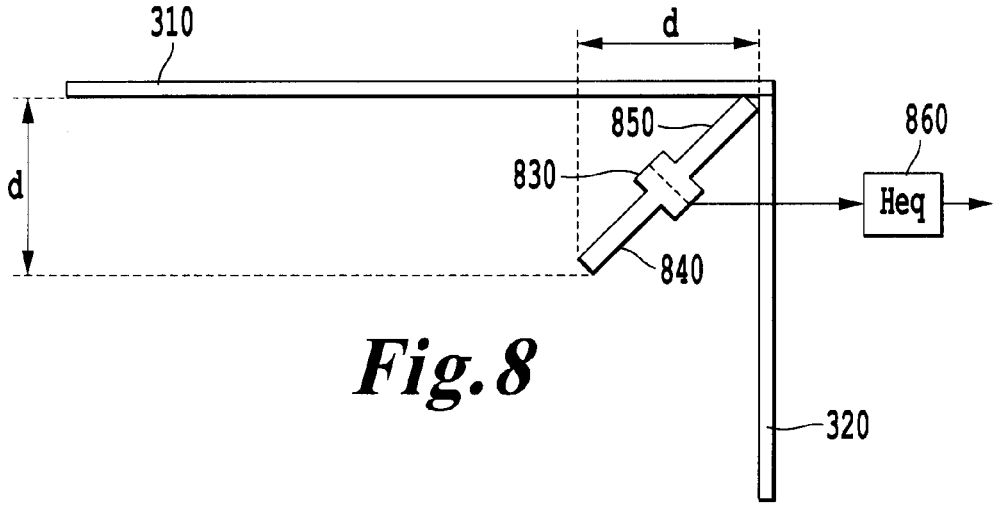
FIG. 8 is a schematic diagram of a ceiling microphone assembly according to a further exemplary embodiment of the present disclosure.
Figure 9:
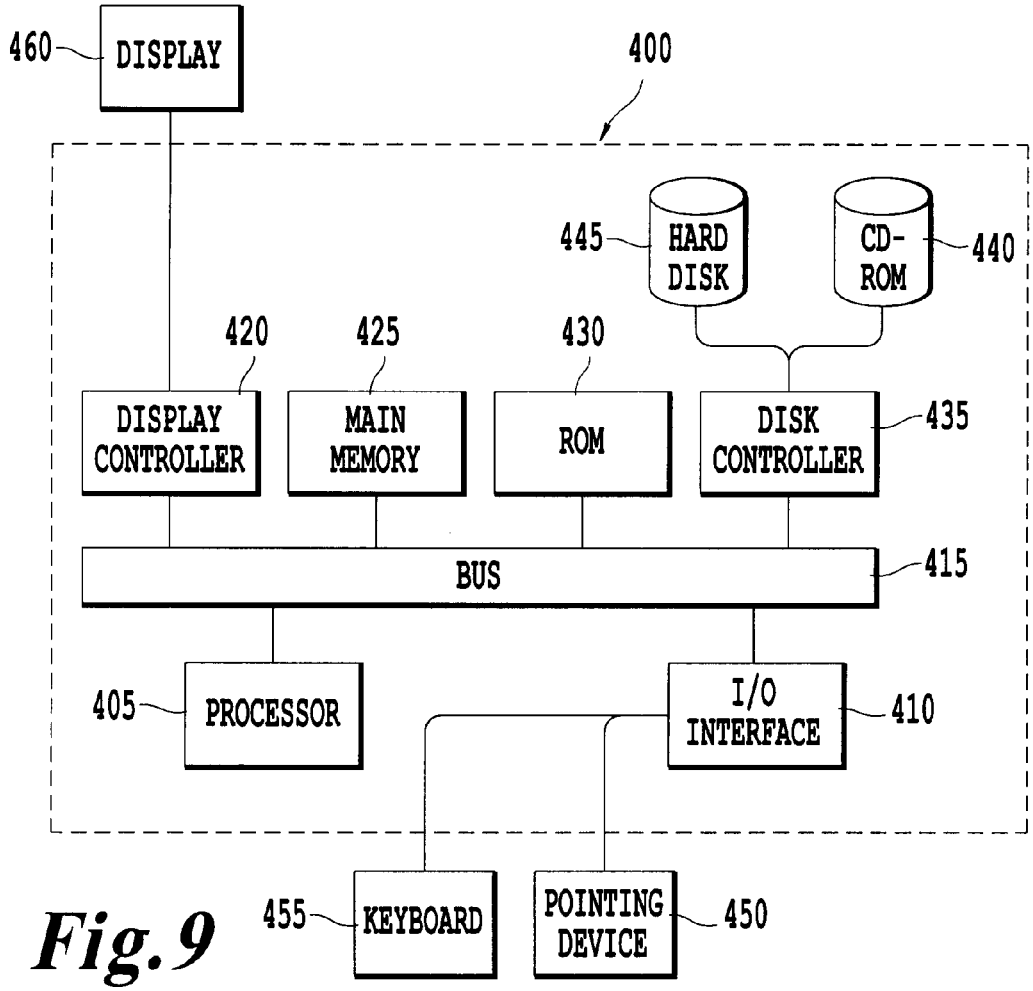
FIG. 9 is a is a schematic drawing of a processor according to aspects of the exemplary embodiments of the present disclosure.

FIG. 8 is a further exemplary embodiment of the ceiling microphone assembly according to the present disclosure. The ceiling microphone in FIG. 8 is implemented using one bidirectional microphone and two waveguides (e.g. tubes). In FIG. 8, a bidirectional microphone 830 is positioned approximately at a distance d/2 from each of the two surfaces 310 and 320. The bidirectional microphone 830 has a front and a rear acoustical input port for allowing sound to enter the microphone from opposite sides. A first waveguide 850 (or tube) have a first waveguide output port that is connected to (associated with) the rear acoustic input port of the bidirectional microphone 830. The first waveguide's 850 input port is arranged adjacent to the intersection of the first and second surfaces 310, 320. A second waveguide 840 has an output port associated with the front acoustic input port of the bidirectional microphone 830. The second waveguide input port is arranged a predetermined distance (d) from the first and second surfaces 310, 320.

Each waveguide 840, 850 may be any linear structure that guides electromagnetic waves. The first and second waveguides 840, 850 are of equal dimensions (length, width, height) and probe audio pressure. The first waveguide 850 probes the audio pressure from the corner between the surfaces 310, 320 and the first waveguide 840 probes the audio pressure at a point displaced by d both horizontally and vertically from the corner. The waveguides 840, 850 transfer the air pressure to the opposite sides of a bidirectional microphone's 830 membrane. Since the two pressures enter at different sides of the membrane, a subtraction function between the two pressures is implemented. In FIG. 8, the equalizing filter $H_{eq}(\omega)$ 860 includes a $1/\omega^2$ factor, and also takes into account any frequency dependency caused by the tubes 840, 850. Such dependencies depend on both the length and width of the tube 840 or 850, as well as the bidirectional microphone 830 itself. The tubes 840 and 850 are preferably equal on both sides of the bidirectional microphone 830 for proper performance.

In addition, the ¼-wavelength resonances of the tubes 840, 850 set a upper frequency limit, and define the size of and distance to the reflecting surfaces 310, 320. The concept of Fresnel zones can be used to estimate when a surface is big enough to be considered a reflector at a certain distance l, as those of skill in the art will recognize. Assuming plane waves, the relationship is then given by $$fa^2=pl,$$

where f is the frequency, a is the smallest dimension of the surface and p is a proportionality constant.

Though the above discussion has been made with reference to traditional microphone elements, other microphone elements may also be used without departing from the spirit of this disclosure. For example, optical microphones and/or MEMs microphones may be used. Optical microphone may reduce the discussed noise problems dramatically. MEMs microphones have the advantage of allowing better component matching if all components, including the microphone, are fabricated on the same silicon wafer or the same silicon die. Of course, the equalizer filter response may have to be modified accordingly. Using the technique with one bi directional microphone with tubes, match between microphones is no longer an issue, since this is implemented by using one single microphone/microphone membrane. Match of the tubes are important, but easily realized.

As first recognized by the present inventor, the ceiling microphone assembly described herein is mounted separately from a conference table. Therefore, it has relatively low sensitivity with respect to audio originating from the table (paper shuffling, keyboard noise from laptops, etc). The ceiling microphone assembly also has a "line of sight" for direct sound from the parties to the teleconference, regardless of any PCs or similar obstructions that may be situated on the conference table. As the ceiling microphone assembly is mounted from the ceiling, no cables are present on the table. Further, the ceiling microphone is fixed and therefore is not vulnerable to incorrect use or displacement.

As first recognized by the present inventors, the ceiling microphone assembly according to the present disclosure introduces directivity to double surface boundary ceiling microphones, reducing reverberation and extending reach. The ceiling microphone described herein has a directivity pattern better suited for normal oval-shaped conference tables, and can be implemented using one microphone, eliminating the need for calibration of microphone elements.

Obviously, numerous modifications and variations of the present invention are possible in light of the above teachings. It is therefore to be understood that within the scope of the appended claims, the invention may be practiced otherwise than as specifically described herein.

The invention claimed is:

1. A microphone assembly, comprising:

an L-shaped structure formed by a first planar surface perpendicularly attached to a second planar surface;

a first microphone element disposed at the intersection of the first and second planar surfaces;

a second microphone element disposed along a line bisecting an angle formed by the first and second planar surfaces, the second microphone element being a predetermined distance from both the first and second planar surfaces;

a first subtractor configured to subtract an output of the first microphone element from an output of the second microphone element; and a first equalizer configured to equalize the output of the first subtractor, the first equalizer having a frequency response of $H_{eq}$, wherein a quarter toroid sensitivity pattern for the microphone assembly is generated by acoustical interaction of the two planar surfaces with the two microphone elements and subtraction of the microphone element outputs.

2. The microphone assembly according to claim 1, wherein the first and second microphone elements are omni directional microphones.

3. The microphone assembly according to claim 1, wherein the microphone assembly is a ceiling microphone.

4. The microphone assembly according to claim 1, wherein the subtractor includes a signal inverter to invert the output of the first microphone element and an adder to combine an output the inverter with the output of the second microphone element to generate the output of the subtractor.

5. The microphone assembly according to claim 1, wherein the quarter toroid sensitivity pattern has a minimum sensitivity at azimuth angles corresponding to 0 degrees and 180 degrees with respect to the first surface and the second surface.

6. The microphone assembly according to claim 1, wherein a product of the predetermined distance and the square-root of two is a maximum of half of a wavelength corresponding to a highest frequency to be captured by the microphone assembly.

7. The microphone assembly according to claim 1, wherein the equalizer frequency response $H_{eq}$ is proportional to $$\frac{1}{\omega^2},$$

and ω is angular frequency.

8. The microphone assembly according to claim 1, wherein the equalizer frequency response $H_{eq}$ includes a low-frequency roll-off at 80 Hz.

9. The microphone assembly according to claim 2, further comprising:

a third microphone element arranged at twice the predetermined distance with respect to both planar surfaces;

a second subtractor to subtract the output of the first microphone element from an output of the third microphone element;

a second equalizer filter to equalize an output of the second subtractor, the second equalizer having a second frequency response $HL_{eq}$;

a high pass filter to filter an output of the first equalizer filter ($H_{eq}$);

a low pass filter to filter an output of the second equalizer filter ($HL_{eq}$); and an adder to combine an output of the high pass filter and an output of the low pass filter.

10. The microphone assembly according to claim 3, wherein $HL_{eq}=H_{eq}$.

11. A microphone assembly, comprising:

an L-shaped structure formed by a first planar surface perpendicularly attached to a second planar surface;

a bidirectional microphone element having a front acoustic input port and a rear acoustic input port;

a first waveguide having an output port associated with the rear acoustic input port of the bidirectional microphone, an input port of the first waveguide being disposed adjacent to an intersection of the first and second planar surfaces;

a second waveguide having an output port associated with the front acoustic input port of the bidirectional microphone element, an input port of the second waveguide being arranged at a predetermined distance (d) from the first and second planar surfaces; and a equalizer filter configured to equalize an output of the bidirectional microphone element, the equalizer having a frequency response ($H_{eq}$), wherein a quarter toroid sensitivity pattern for the microphone assembly is generated by acoustical interaction of the two planar surfaces, the two waveguides and the bidirectional microphone element.

12. The microphone assembly according to claim 11, wherein the first and second waveguide are of equal dimensions.

13. The microphone assembly according to claim 11, wherein the microphone assembly sensitivity pattern has a minimum sensitivity at azimuth angles (β) corresponding to 0 degrees and 180 degrees with respect to a line coinciding with the intersection between the first and second planar surfaces.

14. The microphone assembly according to claim 11, wherein a product of the predetermined distance and the square-root of two is a maximum of half of a wavelength corresponding to a highest frequency to be captured by the microphone assembly.

15. The microphone assembly according to claim 11, wherein the equalizer frequency response ($H_{eq}$) is proportional to $$\frac{1}{\omega^2},$$

and ω is angular frequency.

16. The microphone assembly according to claim 11, wherein the equalizer frequency response ($H_{eq}$) includes a low-frequency roll-off of 80 Hz.

17. A method for creating an quarter toroid directivity pattern in a microphone assembly, comprising:

joining two planar surfaces to form an L-shaped structure;

converting audio waves received at a first microphone into first audio data, the first microphone being arranged adjacent to an intersection of the two planar surfaces;

converting audio waves received at a second microphone into second audio data, the second microphone being arranged at a predetermined distance (d) from each of the two planar surfaces;

subtracting, in a subtractor, the first audio data from the second audio data; and equalizing, in an equalizer, an output of the subtractor.

18. The method according to claim 17, wherein the quarter toroid directivity pattern has a minimum sensitivity at azimuth angles (β) corresponding to 0 degrees and 180 degrees with respect to a line coinciding with the intersection between the two planar surfaces.

19. The method according to claim 17, wherein a produce of the predetermined distance (d) and the square-root of two is a maximum of half of a wavelength corresponding to a highest frequency to be captured by the microphone assembly.

20. The method according to claim 17, wherein the equalizer frequency response ($H_{eq}$) is $$H_{eq} = \frac{1}{\omega^2},$$

and ω is angular frequency.

21. The method according to claim 17, wherein the microphone assembly is a ceiling microphone.

* * * * *